US010335332B2

(12) United States Patent
Morris et al.

(10) Patent No.: US 10,335,332 B2
(45) Date of Patent: Jul. 2, 2019

(54) TOP BAR ACCESSORY FOR WALKER

(71) Applicant: Ganm, LLC, Paris, TN (US)

(72) Inventors: Gary Dempsey Morris, Paris, TN (US); Nancy Elaine Moore-Morris, Paris, TN (US)

(73) Assignee: GANM, LLC, Paris, TN (US)

( * ) Notice: Subject to any disclaimer, the term of this patent is extended or adjusted under 35 U.S.C. 154(b) by 149 days.

(21) Appl. No.: 15/683,897

(22) Filed: Aug. 23, 2017

(65) Prior Publication Data

US 2017/0360634 A1 Dec. 21, 2017

Related U.S. Application Data

(63) Continuation of application No. 14/756,038, filed on Jul. 24, 2015, now Pat. No. 9,763,839.

(51) Int. Cl.

| | |
|---|---|
| ***A61G 5/14*** | (2006.01) |
| ***A61H 3/00*** | (2006.01) |
| *A61H 3/02* | (2006.01) |

(52) U.S. Cl.

CPC ..... *A61G 5/14* (2013.01); *A61H 3/00* (2013.01); *A61H 3/0277* (2013.01); *A61H 2003/0205* (2013.01); *A61H 2201/0192* (2013.01)

(58) Field of Classification Search

USPC ..... 135/74; 16/422

See application file for complete search history.

(56) References Cited

U.S. PATENT DOCUMENTS

| | | | |
|---|---|---|---|
| 2,757,388 | A | 8/1956 | Chisholm |
| 3,553,746 | A | 1/1971 | Seiger |
| 3,591,874 | A | 7/1971 | O'Kennedy |
| 4,274,430 | A | 6/1981 | Schaaf et al. |
| 4,314,576 | A | 2/1982 | McGee |
| 4,474,202 | A | 10/1984 | Blechner |
| 4,510,957 | A | 4/1985 | Frank |
| 4,765,355 | A | 8/1988 | Kent |
| 4,800,910 | A | 1/1989 | Gamm |
| 4,843,661 | A | 7/1989 | Skibinski |
| 4,884,587 | A | 12/1989 | Mungons |
| 4,922,560 | A | 5/1990 | Skibinski |
| 4,985,947 | A | 1/1991 | Ethridge |
| 4,987,912 | A | 1/1991 | Taylor |

(Continued)

FOREIGN PATENT DOCUMENTS

| | | |
|---|---|---|
| EP | 1809229 A2 | 7/2007 |
| WO | 2006/052778 A2 | 5/2006 |

*Primary Examiner* — David R Dunn

*Assistant Examiner* — Danielle Jackson

(74) *Attorney, Agent, or Firm* — Thompson Coburn LLP

(57) ABSTRACT

A walker standing aid accessory package consists of a lower attachment and an upper attachment. The lower foot bar piece allows the caregiver to utilize body weight to pin the walker's front legs to the floor or ground surface securely. The upper part incorporates multiple hand placement stabilization choices for both the patient and the caregiver. This invention increases the patient's self help and reduces most of the caregiver's exertion. Once the patient is standing upright, the caregiver may step aside and monitor said patient's immediate ambulation. The accessory package converts an existing walker into a device that not only helps the patient to stand but also reduces the strain on the caregiver. The walker with the accessories installed offers no interference or compromise to the existing walker's integrity, mobility or storage.

11 Claims, 7 Drawing Sheets

(56) References Cited

U.S. PATENT DOCUMENTS

| | | | |
|---|---|---|---|
| 5,005,599 | A | 4/1991 | Cunningham |
| 5,347,666 | A | 9/1994 | Kippes |
| 5,657,783 | A | 8/1997 | Sisko et al. |
| 5,794,284 | A | 8/1998 | Southwell, Jr. et al. |
| 5,853,015 | A | 12/1998 | Evans |
| 5,983,911 | A | 11/1999 | Steele |
| 6,044,507 | A | 4/2000 | Smith |
| 6,170,501 | B1 | 1/2001 | Cook et al. |
| 6,244,265 | B1 | 6/2001 | Cronk et al. |
| 6,467,797 | B1 | 10/2002 | Lofy et al. |
| 7,363,931 | B2 | 4/2008 | Weaver |
| 7,377,285 | B2 | 5/2008 | Karasin et al. |
| 8,166,987 | B2 | 5/2012 | Weaver |
| 8,714,171 | B1 | 5/2014 | Haygood |
| 8,726,922 | B2 | 5/2014 | Pak et al. |
| 2002/0179131 | A1 | 12/2002 | Johnson et al. |
| 2003/0151232 | A1 | 8/2003 | Li |
| 2009/0301533 | A1 | 12/2009 | Caldwell |
| 2011/0232665 | A1 | 9/2011 | Barnett, Jr. |
| 2014/0371038 | A1 | 12/2014 | Markowitz |
| 2015/0090308 | A1 | 4/2015 | Bos et al. |

TOP BAR ACCESSORY FOR WALKER

CROSS-REFERENCE TO RELATED APPLICATIONS

This application is a continuation of U.S. patent application Ser. No. 14/756,038, filed Jul. 24, 2015, currently pending, the disclosure of which is incorporated by reference herein.

BACKGROUND OF INVENTION

The present invention relates to a mobility aid accessory package which is applied to an already existent walker ambulation device framework.

It has been determined by study of prior art that many attempts have successfully accomplished the task of assistance to a person trying to move from a seated to a standing position.

It has been further determined through investigation and observation that once standing upright, the individual is often unable to make transfer from one device to another, due to tripping hazards or patient instability.

The present invention overcomes this obstacle through an accessorizing method of applying specifically designed aid devices to the patient's already existent walker appliance. This invention also aids the caregiver in that the caregiver can use the caregiver's body weight and minimal physical exertion to assist the patient. Once standing, the patient is then able to begin ambulation immediately. This invention also works in reverse when the patient needs to be seated.

The accessorizing method adds little weight to a walker and the walker may still be folded closed and immediately transported with the person or patient to the next needed location.

SUMMARY OF INVENTION

Many types and configurations of personal assisting devices are known. Most devices are able to assist patients with rising from a seated to standing position. However, in most cases, the devices are stand alone and do not allow the patient or person ambulation. There then becomes a need in those cases for transference to some other conveyance.

The accessories herein described not only overcome much of the difficulty that a person experiences when trying to stand, but also aid the caregiver in helping the patient/person to a standing position using the caregiver's own weight applied to the footbar, as a counter balance along with hand stabilization applied to the top piece. The caregiver exerts little physical effort during this maneuver. The same walker that was utilized for assistance is then already in position for the person's or patient's immediate ambulation.

The accessory (Lower and Upper Units) work together for the combined purpose of assistance in rising, as well as sitting back down. The accessories do not interfere with patient/person motion and are away from any path that would result in a tripping hazard during ambulation.

The incorporation of the foot bar works to counteract tipping motion of the walker and the hand grip locations at the top of the walker allow choices for both the patient/person or the caregiver for needed hand placement.

Once the patient/person is upright and stable, the caregiver moves away, and the walker is allowed to function and provide support as per its originally intended design.

The accessory package does not compromise any of the existing walker's integrity and requires no walker modification. All accessories are clamped to or slip mounted to the existing walker framework. With the accessories installed, the walker experiences a very small amount of added weight and still may be folded closed or opened as per its original design.

BRIEF DESCRIPTIONS OF THE DRAWINGS

DETAILED DESCRIPTION

Figure 1:
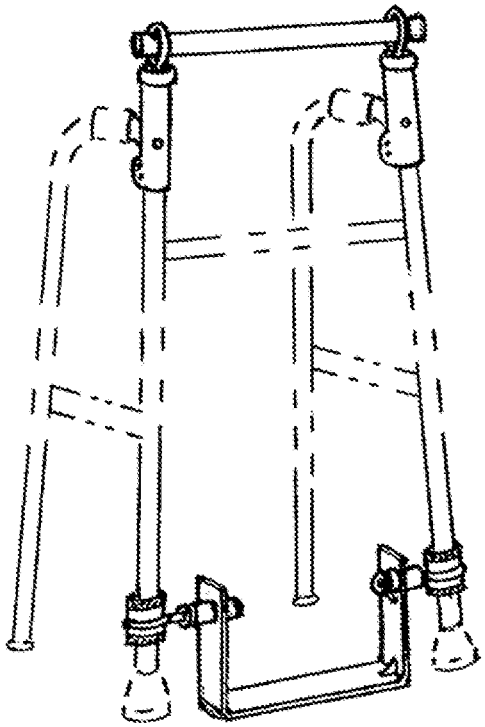
FIG. 1 is a perspective view of upper and lower accessory package installed on an existing walker (the walker being shown in phantom) with numbers removed.
Figure 2:
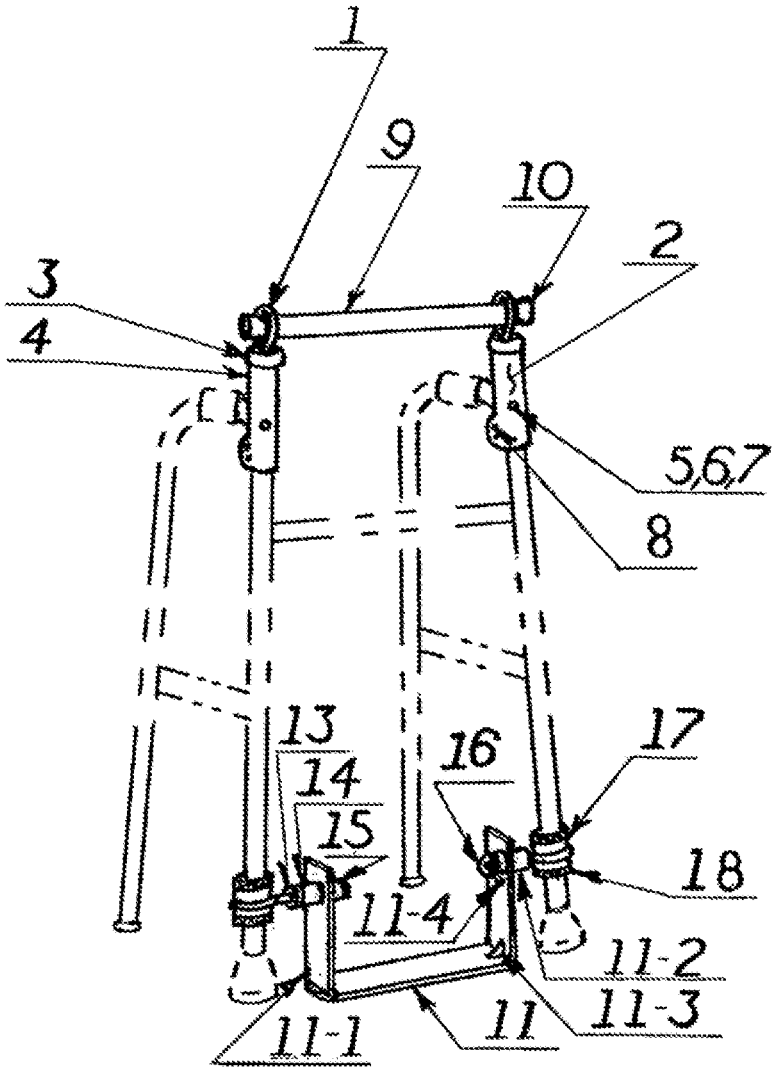
FIG. 2 is a perspective view of upper and lower accessory package installed on an existing walker (the walker being shown in phantom) with numbers assigned.
Figure 3:
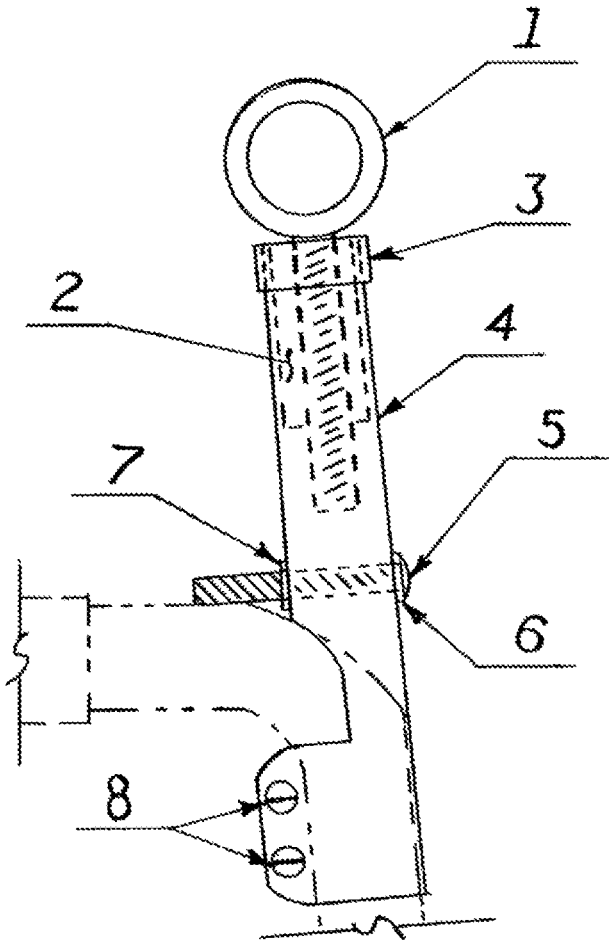
FIG. 3 is a view of an upright piece installed on a walker framework (the walker being shown in phantom).
Figure 4:
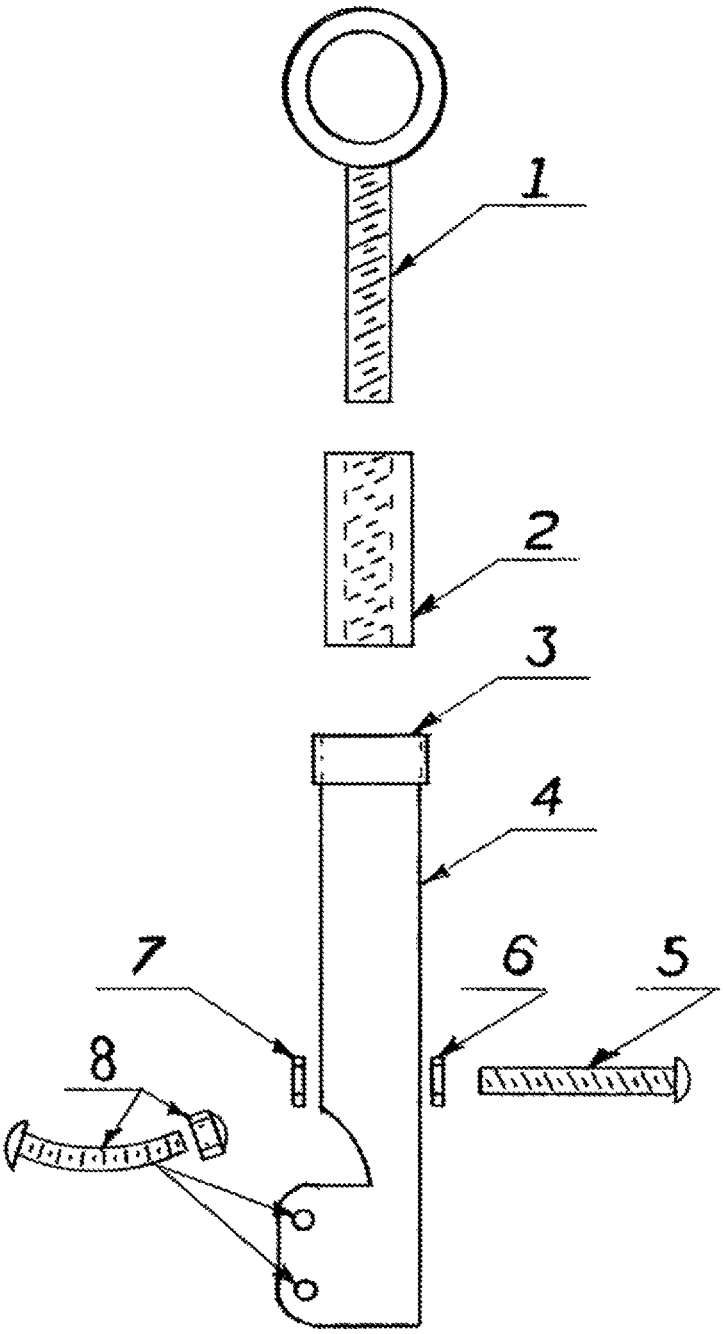
FIG. 4 is an exploded view of the upright piece of FIG. 3.
Figure 5:
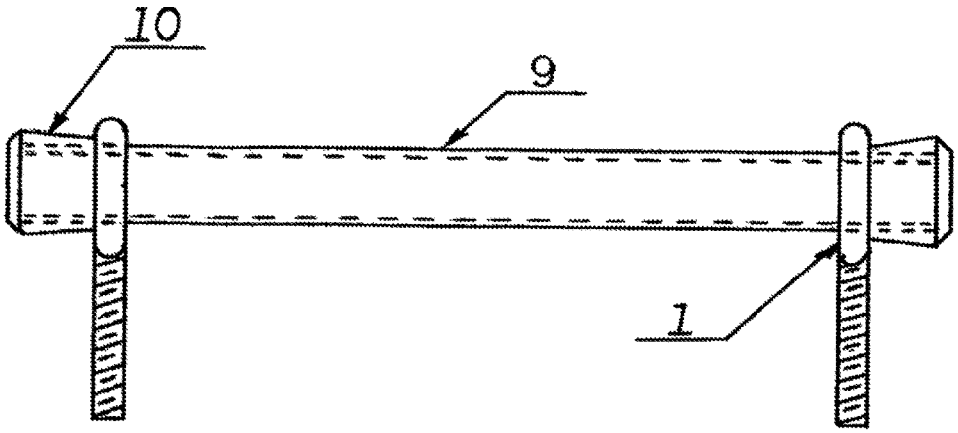
FIG. 5 is a view of a round tubular crossbar piece positioned in eyelet bolts of the upright pieces of FIG. 3.
Figure 6:
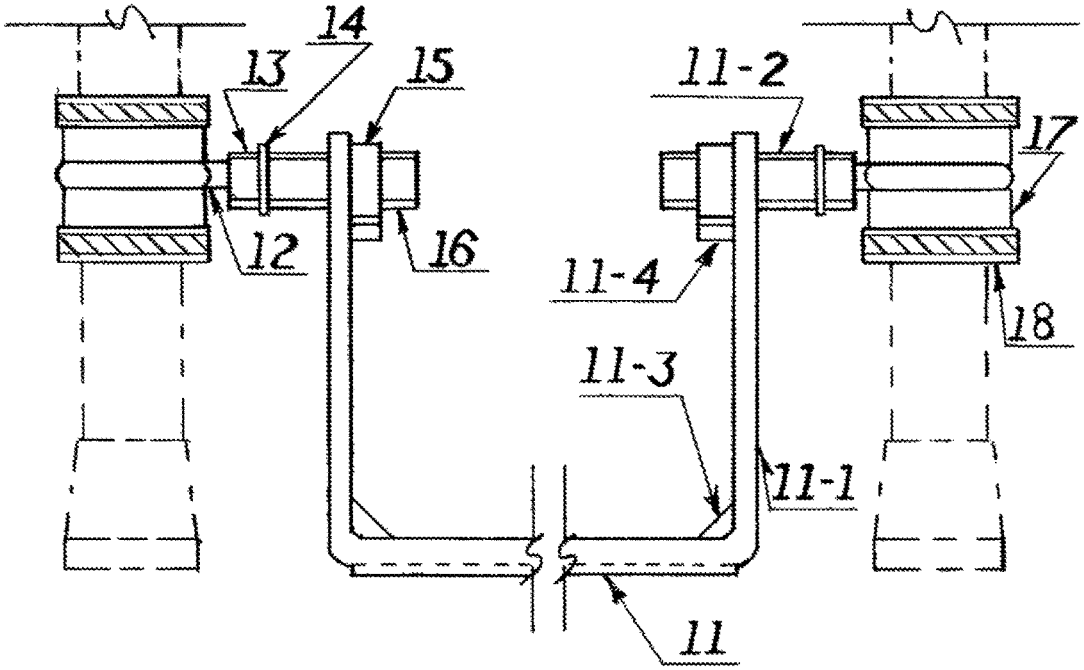
FIG. 6 is a view of a foot bar piece installed on lower front legs of an existing walker (the walker being shown in phantom).
Figure 7:
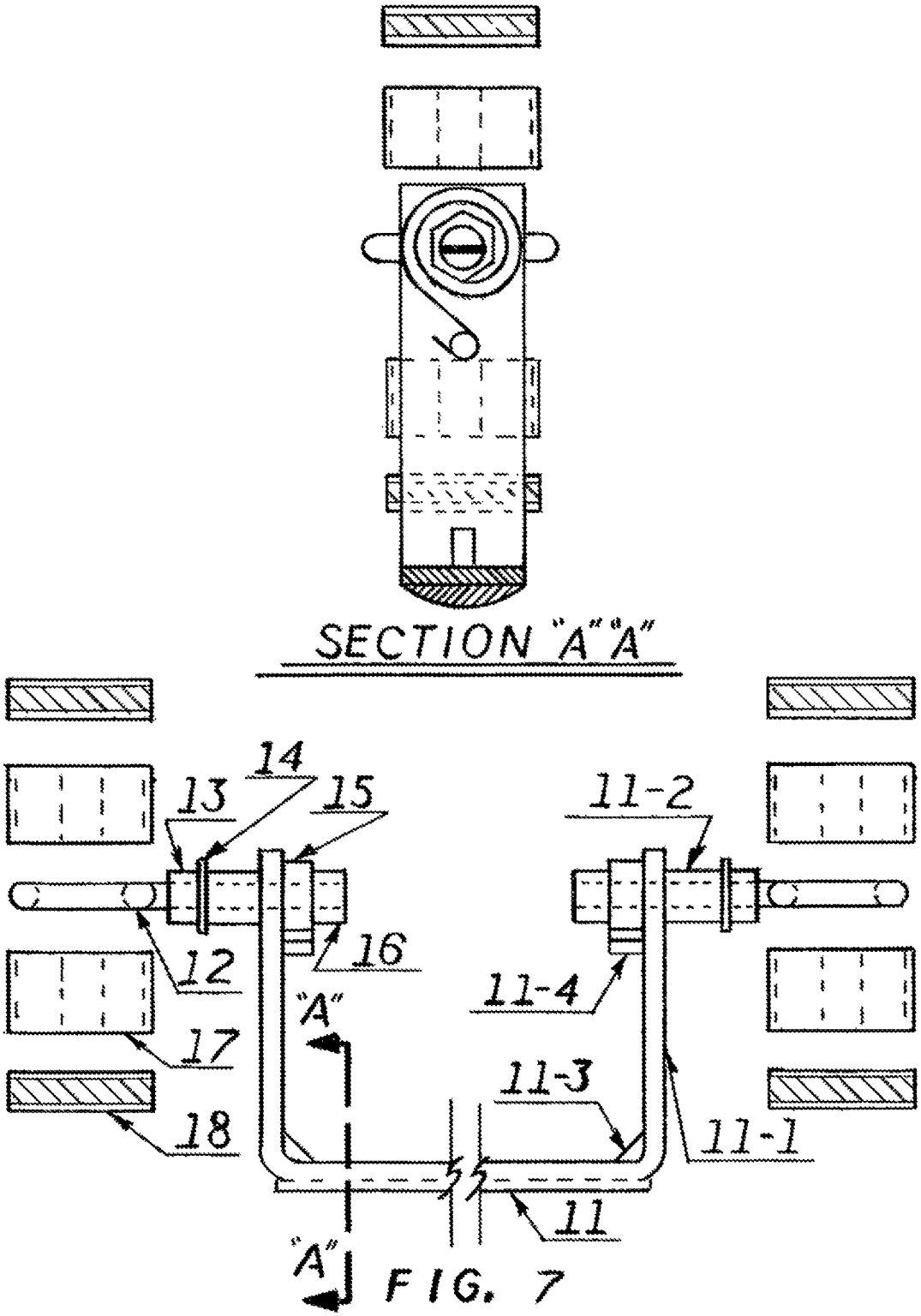
FIG. 7 is an exploded view and sectional view of the foot bar piece of FIG. 6.

The prior art offers many aids and solutions to lessen the hardship that handicapped persons suffer while trying to stand, sit or ambulate. The hardship is extended to the caregiver when additional assistance is required.

The present invention is an accessory package designed to be installed on and to increase the capability of an existent walker appliance. The prior art has revealed many stand-alone appliances. Accessorizing as is herein described has not been identified in prior art.

The installed walker standing aid accessory package affords the caregiver the ability to assist someone to stand or sit with little caregiver exertion. This is accomplished by the accessory foot bar piece and the accessory upright pieces.

The caregiver applies pressure with one foot to the foot bar. The foot bar has a rotation action incorporated therewith. Said rotation allows the base of the foot bar to rotate forward toward the caregiver and to make contact with the floor or ground surface. This locks the walker's front legs to the floor and prevents forward, backward or lateral motion. Additionally, the caregiver utilizes the top-part-installed accessories to further stabilize the walker by grasping the top crossbar or the upright supports.

Once the caregiver stabilizes the walker, the patient may grasp the existing walker framework of the patient's choice, for instance, the upright pieces, the top crossbar or using any combination thereof.

As the patient pulls his or herself upward, the caregiver acts as a counter opposing force.

The same method may be utilized in reverse to allow the patient to seat his or herself.

Once the patient is in the standing position, the caregiver releases the caregiver's grasp of the top accessory area and the caregiver's foot from the foot bar.

The foot bar automatically rotates back up to its original position away from the floor surface. The walker is now ready to allow the patient immediate ambulation.

There is no need for transfer to any other appliance and tripping hazards are eliminated due to the location of the accessory placement.

The following elemental descriptions explain in detail each component numerically identified in the previous drawing illustrations.

A threaded eye bolt (1) provides support for both ends (Left and Right) of a crossbar piece (9). The threaded length of the insert (2) provides allowance for height adjustment and swivel rotation. Said rotation accommodates the opening and closing of the walker while maintaining the appliance attachment.

The threaded insert (2) is fitted permanently in the top portion of the left and right upright pieces (4). The insert provides the mounting location for the threaded eye bolt (1).

Protective caps (3) are incorporated to provide safety and hand comfort for the user or caregiver and secure the cross bar (9) in place.

The upright piece (4) provides vertical hand grip support along with a mounting location for the crossbar piece. The upright pieces are bolted or clamped to the left and right upper frontal area of an existing walker. The composition may be metallic or composite. The lower portion of the upright piece is contour fabricated to allow full surface contact with the walker framework. The upright piece is also predrilled clear through to receive a bracing bolt (5) which further supports the upright piece (4).

The brace support bolt (5) includes a brace support bolt adjusting nut (6) and brace support bolt lock nut (7). The bracing bolt (5) extends through the drilled hole at the lower portion of the upright piece (4) and is adjusted to make contact with the upper tubular portion at left and right sides of the walker framework. The bracing bolt (5) is then locked in place and helps counter act any pulling force applied to the upright or crossbar pieces.

The brace support bolt adjusting nut (6) is described above.

The brace support bolt lock nut (7) is described above.

The upright piece clamping bolts (8) affix the upright pieces (4) to the left and right side of the frontal upper portion of the existing walker. The upright pieces (4) are slipped onto the upper portion of the existing walker left and right sides. Once in place the clamping bolts (8) hold the upright pieces (4) securely to the walker framework. In lieu of bolts (8), the upright pieces (4) may be bolted to the walker at the same location but permission must be given for any breaching or drilling the existing walker framework.

The crossbar piece (9) is round/tubular in construction and is fabricated from either metallic or composite materials. The crossbar piece provides a connection between the left and right upright pieces (4). The crossbar piece passes through the eyelet portion of the eyelet bolts (1) and is locked in place by crossbar piece protective locking caps (10). The crossbar piece provides the assisted person or the caregiver a horizontal hand placement location. The pulling motion on either the horizontal crossbar piece (9) or the vertical upright piece (4) is counter acted by the opposing force of the caregiver's hand placement along with the locking of the foot bar piece to the floor surface provided by the caregiver. Said locking of the foot bar piece will be explained hereafter.

Protective locking caps (10) are described above.

The foot bar piece (11) is attached to the lower frontal legs area of an existing walker. Said foot bar piece (11) is fabricated of either metallic or composite materials or combination thereof.

The foot bar piece (11) and cross bar piece (9) are used in conjunction by the caregiver. The caregiver places his or her foot on the foot bar piece when assisting a seated person to stand. The body weight of the caregiver pins the front legs of the walker to the floor or ground surface via the foot bar piece. This pinning arrangement provides a counteracting force when the patient/person utilizes the top portion to pull against while trying to rise from a seated position. This greatly decreases the strength normally required from the caregiver to assist the patient. When not in use the foot bar piece (11) rotates back upward.

Once the patient or person is upright and safely standing, the caregiver steps away from the front of the walker and the person then utilizes the walker as originally intended for ambulation.

With reference to the foot bar piece (11), the lowest part of foot bar piece (11) is fabricated flat on the top side and curved on the floor surface contact side. This configuration allows the foot bar piece (11) to smoothly release contact with the floor surface when caregiver foot pressure is removed. The foot bar piece (11) includes left and right drop down suspensions (11-1) allowing adequate height to connect the foot bar piece to the walker leg framework at an elevated location that does not interfere with walker wheels, glides etc. The elongated nuts (11-2) are permanently affixed to drop downs (11-1) at the top locations. Said nuts allow the drop downs (11-1) to receive threaded eyelet bolts (12). The combination of threaded nuts and threaded eyelet bolts provide the necessary pivoting locations (upward and downward) for foot bar piece (11). The torsion spring mounting post (11-4) is permanently affixed to an upper location of the drop down suspensions (11-1). The torsion spring mounting post (11-4) receives the outermost end of torsion springs (15).

With further reference to drop down suspensions (11-1), said drop down suspensions are drilled clear through to allow the threaded portions of the eyelet bolts (12) to extend through the upper portion of drop downs (11-1).

With further reference to foot bar piece (11), reinforcing gussets (11-3) help reduce flexing action between the foot bar lower part and the drop down suspensions (11-1).

With further reference to foot bar piece (11), foot bar piece (11) has left and right top portion eyelet bolts (12). Said eyelet bolts allow the foot bar piece to be mounted on an existing walker's frontal area near the base. Said eyelet bolts provide a rigid support for the foot bar piece (11) while simultaneously allowing frontal walker legs to rotate therein approximately ninety degrees. Said rotation accommodates the opening and closing of walker frame work without removal of foot bar piece (11). The eyelet bolts (12) are fabricated with a slotted thread arrangement. Said slot provides the necessary mounting for the center portion of torsion springs (15). Said torsion springs allow the foot bar piece (11) to return to the upright position once the caregiver's foot pressure has been removed. Once the foot bar piece is rotated back to its up position, the torsion spring (15) holds the footbar piece (11) upward and away from the path of ambulation.

With further reference to the eyelet bolts (12), eyelet bolts (12) provide the necessary mounting for stop nuts (13), a spacer (14), torsion springs (15), and a locking cap nut (16). The stop nuts (13) provide both upward and downward travel limitation for the foot bar piece (11). The spacer (14) provides a separation with slippage between the stop nuts (13) and the elongated nuts (11-2). The torsion spring (15) allows the foot bar piece to automatically return to the upright position when the caregiver's foot is removed from the foot bar piece (11). The above-described assembly is secured in place by locking the cap nuts (16).

With further reference to foot bar piece (11) and the eyelet bolts (12), the foot bar piece makes contact with walker leg framework at the bolt eyelet location. The eyelet bolts on the left and right sides are supported via top and bottom support sleeves (17). Said support sleeves slide onto and tightly grip the existing walker legs on both left and right sides. The eyelet bolts (12) rest on lower support sleeves on both left and right sides while the upper support sleeves help provide proper alignment and rigidity. Additionally, the support sleeves are slotted vertically top to bottom in order to accommodate the walker leg adjusting pins. The walker may then be height adjusted with the foot bar assembly (11) installed.

With further reference to the top and bottom support sleeves (17), said sleeves are securely held in place by compression clamps (18).

What is claimed is:

1. An accessory package for a walker, the accessory package comprising:

a cross bar having opposite first and second ends; and first and second pivot connections configured to connect to the respective first and second ends of the cross bar to the respective laterally opposite sides of a frame of the walker, each of the pivot connections comprising;

an eyelet portion adapted and configured to receive one of the first and second ends of the cross bar, the eyelet portion having a stem with a stem axis extending along a length of the stem; and an upright piece adapted and configured to be removable attachable to the respective lateral opposite sides of the frame with mechanical fasteners, the upright piece having an outer shape formed to conform to a framework of the walker such that when the upright piece is removably connected to the framework of the walker with the mechanical fasteners, the upright piece is constrained from relative movement with the framework of the walker, the upright piece being adapted and configured to receive the stem and permit adjustment of the length of the stem received within the upright piece along the stem axis, the upright piece being adapted and configured to allow relative rotation of the stem within the upright piece about the stem axis thereby allowing pivoting of the upright piece about the stem axis;

further comprising a locking cap adapted and configured to be fitted to the respective first and second ends of the cross bar to secure the cross bar within the eyelet portion.

2. The accessory of claim 1 further comprising a sleeve fixedly mounted within the upright piece, the sleeve being removably connectable with the eyelet portion of the stem.

3. The accessory of claim 2 wherein the sleeve is threadably connected with the eyelet portion of the stem.

4. The accessory of claim 1 further comprising a cap adapted and configured to fit over a distal end of the upright piece.

5. The accessory of claim 1 wherein the upright piece has a sleeve portion that conforms to the framework of the walker.

6. The accessory of claim 1 wherein the sleeve portion may be drawn around the walker framework with the mechanical fasteners.

7. The accessory of claim 1 wherein the mechanical fasteners for connecting the upright piece to the walker framework comprises at least a threaded bolt.

8. A walker comprising:

a frame with opposite lateral sides;

a cross bar having opposite first and second ends each having pivot connections with the respective laterally opposite sides of a frame of the walker, each of the pivot connections comprising an eyelet portion adapted and configured to receive one of the first and second ends of the cross bar and an upright extending from the respective lateral side of the walker frame, the eyelet portion having a stem with a stem axis extending along a length of the stem, the stem being received in the upright in a manner to permit adjustment of the length of the stem received within the upright along the stem axis and to allow relative rotation of the stem within the upright piece about the stem axis thereby allowing pivoting of the upright piece about the stem axis; and a foot bar having first and second ends each operatively pivotally connected to respective opposite lateral sides of the frame about a foot bar pivot axis, the foot bar having a bearing surface extending between the first and second ends, the foot bar being pivotal about the foot bar pivot axis between a retracted position in which the foot bar bearing surface is spaced from a support surface on which the walker is placed, and a deployed position in which the foot bar bearing surface moves parallel and adjacent to the support surface on which the walker is placed, the foot bar pivot axis being offset from the foot bar bearing surface and extending in a direction from one lateral side of the walker to the opposite lateral side of the walker; and further comprising a locking cap adapted and configured to be fitted to the respective first and second ends of the cross bar to secure the cross bar within the eyelet portion.

9. The walker of claim 8 further comprising a sleeve fixedly mounted within the upright piece, the sleeve being removably connectable with the eyelet portion of the stem.

10. The walker of claim 9 wherein the sleeve is threadably connected with the eyelet portion of the stem.

11. The walker of claim 8 further comprising a cap adapted and configured to fit over a distal end of the upright piece.

* * * * *